US012564245B2

(12) United States Patent
Fogarty et al.

(10) Patent No.: US 12,564,245 B2
(45) Date of Patent: Mar. 3, 2026

(54) SHOE WITH INTERCHANGEABLE UPPER

(71) Applicant: Solely Jane Holdings, LLC, Springville, UT (US)

(72) Inventors: Cindy Fogarty, Millmerran (AU); Nate Finlay, South Salt Lake, UT (US); Jennie Drew Platt, Salt Lake City, UT (US); Douglas M. Hintze, Saratoga Springs, UT (US); Connor R. Wright, Springville, UT (US); Christopher R. Huntington, South Jordan, UT (US); Jonothan D. DiPeri, Springville, UT (US)

(73) Assignee: Solely Jane Holdings, LLC, Springville, UT (US)

( * ) Notice: Subject to any disclaimer, the term of this patent is extended or adjusted under 35 U.S.C. 154(b) by 0 days.

(21) Appl. No.: 18/827,637

(22) Filed: Sep. 6, 2024

(65) Prior Publication Data

US 2024/0423323 A1 Dec. 26, 2024

Related U.S. Application Data

(63) Continuation-in-part of application No. 18/637,255, filed on Apr. 16, 2024, now abandoned, which is a continuation of application No. 29/841,474, filed on Jun. 6, 2022, now abandoned, and a continuation of application No. 29/841,476, filed on Jun. 6, 2022, now Pat. No. Des. 1,027,402, said application No. 29/841,474 is a continuation of application No. 16/807,700, filed on Mar. 3, 2020, now Pat. No. 11,350,698, said application No. 29/841,476 is a continuation of application No. 16/807,700, filed on Mar. 3, 2020, now Pat. No. 11,350,698.

(51) Int. Cl.

| | |
|---|---|
| ***A43B 13/36*** | (2006.01) |
| ***A43B 3/24*** | (2006.01) |
| ***A43B 23/22*** | (2006.01) |

(52) U.S. Cl.

CPC ..... *A43B 13/36* (2013.01); *A43B 3/24* (2013.01); *A43B 3/244* (2013.01); *A43B 23/222* (2013.01)

(58) Field of Classification Search

CPC ..... A43B 13/36; A43B 13/28; A43B 23/222; A43B 3/24; A43B 3/244; A43B 3/246

USPC ..... 36/15, 100, 101

See application file for complete search history.

(56) References Cited

U.S. PATENT DOCUMENTS

| | | | |
|---|---|---|---|
| 453,985 | A | 6/1891 | Seaver |
| D27,961 | S | 12/1897 | Walden |
| D29,914 | S | 12/1898 | Merrick |
| 679,978 | A | 8/1901 | Merrick |
| D83,027 | S | 1/1931 | Arnold |
| 2,368,314 | A | 1/1945 | Marx |
| 2,382,495 | A | 8/1945 | Malatesta, Jr. |

(Continued)

*Primary Examiner* — Marie D Bays

(74) *Attorney, Agent, or Firm* — Young Basile Hanlon & MacFarlane, P.C.

(57) ABSTRACT

A shoe includes a base and an upper. The base is configured to contact a ground and includes a groove. The upper is configured to extend over a foot of a user. The upper includes a rail configured to be inserted into the groove to connect the upper to the base. The groove and the rail cooperatively form a detent that is configured to selectively inhibit relative movement between the rail and the groove when the rail is fully inserted into the groove.

19 Claims, 13 Drawing Sheets

(56) References Cited

U.S. PATENT DOCUMENTS

| | | | | | |
|---|---|---|---|---|---|
| 2,519,108 | A * | 8/1950 | Bryant | A43B 3/24 | 36/12 |
| 2,552,943 | A * | 5/1951 | Danielius | A43B 3/24 | 36/15 |
| 2,761,224 | A * | 9/1956 | Gardiner | A43B 3/24 | 36/15 |
| 3,204,346 | A * | 9/1965 | Lockard | A43B 3/24 | 36/15 |
| 3,769,722 | A | 11/1973 | Rhee | | |
| 4,326,313 | A | 4/1982 | Bensley | | |
| 4,343,057 | A * | 8/1982 | Bensley | A43B 15/00 | 12/142 D |
| 4,420,894 | A | 12/1983 | Glassman | | |
| 4,586,209 | A * | 5/1986 | Bensley | A43B 15/00 | 36/15 |
| 4,887,369 | A | 12/1989 | Bailey et al. | | |
| 5,065,531 | A * | 11/1991 | Prestridge | A43B 23/0245 | 36/15 |
| 5,317,822 | A | 6/1994 | Johnson | | |
| 5,337,491 | A | 8/1994 | Mascotte | | |
| D385,999 | S | 11/1997 | Tong | | |
| 5,983,528 | A | 11/1999 | Hartung | | |
| 7,698,834 | B1 * | 4/2010 | Courville | A43B 3/103 | 36/15 |
| D619,795 | S | 7/2010 | McBride | | |
| D630,425 | S | 1/2011 | Olaverri et al. | | |
| D747,082 | S | 1/2016 | Lan | | |
| D756,103 | S | 5/2016 | Gittens | | |
| 9,700,107 | B1 * | 7/2017 | De Andrade | A43C 11/12 | |
| 11,350,698 | B2 * | 6/2022 | Fogarty | A43B 3/242 | |
| D986,539 | S | 5/2023 | Kozen | | |
| D997,523 | S | 9/2023 | Yung | | |
| 2005/0235522 | A1 | 10/2005 | Crowley et al. | | |
| 2008/0098623 | A1 | 5/2008 | Komitau | | |
| 2009/0229145 | A1 | 9/2009 | Ortner | | |
| 2013/0269214 | A1 * | 10/2013 | Fogarty | A43B 3/24 | 36/100 |
| 2014/0033568 | A1 | 2/2014 | Pearson | | |
| 2016/0095379 | A1 | 4/2016 | Fogarty | | |
| 2017/0224047 | A1 | 8/2017 | Walker | | |
| 2018/0325208 | A1 * | 11/2018 | Delaney | A43B 3/122 | |
| 2021/0274883 | A1 * | 9/2021 | Fogarty | A43B 3/242 | |

* cited by examiner

SHOE WITH INTERCHANGEABLE UPPER

CROSS-REFERENCE TO RELATED APPLICATION(S)

This application is a continuation-in-part of U.S. patent application Ser. No. 18/637,255 filed Apr. 16, 2024, which is (1) a continuation of U.S. patent application Ser. No. 29/841,474 filed Jun. 6, 2022, which is a continuation of U.S. patent application Ser. No. 16/807,700 filed Mar. 3, 2020 (now U.S. Pat. No. 11,350,698); and (2) a continuation of U.S. patent application Ser. No. 29/841,476 filed Jun. 6, 2022, which is a continuation of U.S. patent application Ser. No. 16/807,700 filed Mar. 3, 2020 (now U.S. Pat. No. 11,350,698). Each of the foregoing patent applications is hereby incorporated by reference.

TECHNICAL FIELD

This disclosure relates generally to shoes, and more particularly to shoes having an upper that is selectively removable from a base thereof so that different uppers may be used in connection with the base.

BACKGROUND

Purchasing a large variety of shoes to complete multiple outfits may be costly. Additionally, when traveling for vacation, business, or the like, transporting multiple pairs of shoes to support multiple outfits may be undesirable. Accordingly, what is needed is a shoe that can adapt to multiple outfits and takes up little storage space.

SUMMARY

One aspect of this disclosure is a shoe that may include a base that is configured to contact a ground. The base may include a groove. The shoe may also include an upper that is configured to extend over a foot of a user. The upper may include a rail that is configured to be inserted into the groove to connect the upper to the base. The groove and the rail may cooperatively form a detent that is configured to selectively inhibit relative movement between the rail and the groove when the rail is fully inserted into the groove.

Another aspect of this disclosure is an interchangeable shoe that may include a base, an upper, and an attachment. The attachment may be configured to releasably attach the upper to the base. The attachment may include a groove in the base, in which the groove includes a first portion of a detent. The attachment may also include a rail that is attached to the upper. The rail may be configured to be inserted into and removed from the groove. The rail may include a second portion of the detent that is configured to mate with the first portion of the detent.

Another aspect of this disclosure is a modular shoe that may include a base that is configured to support a weight of a user. The base may include a groove, and the groove may include a geometric feature. The modular shoe may also include an upper that is configured to extend over a foot of the user. The upper may include a rail that is configured to be inserted into the groove to releasably couple the upper to the base. The rail may include a toe portion. The geometric feature may be configured to extend over an entirety of a width of the groove to cover the toe portion of the rail when the rail is fully inserted into the groove.

BRIEF DESCRIPTION OF THE DRAWINGS

The disclosure is best understood from the following detailed description when read in conjunction with the accompanying drawings. It is emphasized that, according to common practice, the various features of the drawings are not necessarily to-scale. On the contrary, the dimensions of the various features may be arbitrarily expanded or reduced for clarity.

DETAILED DESCRIPTION

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1:
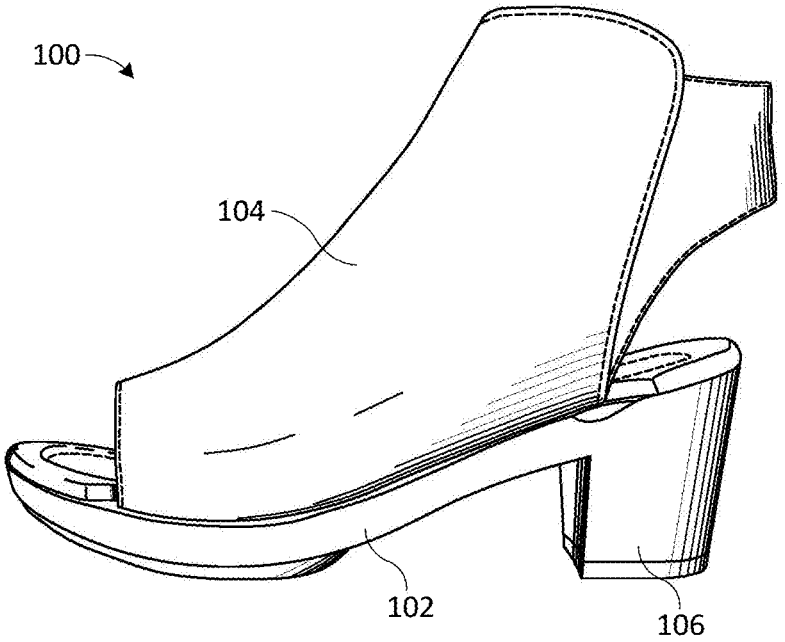
FIG. 1 is a side view of a shoe according to an example.

Referring to FIG. 1, an example of a shoe 100 is illustrated. The shoe 100 is an item of footwear intended to protect a human foot. The shoe 100 may also be an item of decoration (e.g., fashion). The shoe 100 may take any form including, without limitation, a basic sandal (e.g., comprising a thin sole, simple strap(s), etc.), an athletic shoe (e.g., comprising a shock absorbing sole, breathable materials, etc.), a dress shoe (e.g., comprising high-end materials, ornamental designs, etc.), or any other type and/or configuration of shoe. The shoe 100 may be any size to fit a size of a foot of a user.

The shoe 100 may comprise a base 102 and an upper 104. In some implementations, the upper 104 may be removably coupleable to the base 102 such that the base 102 or the upper 104 may be changed with respect to one another depending on the preferences of the user. Accordingly, the shoe 100 may be referred to herein as a modular shoe and/or an interchangeable shoe. For example, a user may retain the base 102 and replace the upper 104 with another version of the upper 104 having a different color that better matches the outfit (e.g., shirt, pants, etc.) of the user. As another example, a user may retain the base 102 and replace the upper 104 with another version of the upper 104 having higher breathability (e.g., that allows greater airflow to the foot) when the user intends to enter a hot environment. As yet another example, a user may retain the upper 104 and replace the base 102 with another version of the base 102 having a shorter heal when the user intends to walk long distances. In other words, the shoe 100 may allow the user to select the base 102 and the upper 104 independently, and then releasably secure the upper 104 to the base 102 to prepare the shoe 100 for use.

The base 102 may be the portion of the shoe 100 that contacts the ground and on which the user's foot rests. That is, the base 102 of the shoe 100 may be the portion that supports the weight of the user. The base 102 may be made from a variety of materials including, without limitation, natural rubber, polyurethane, polyvinyl chloride (PVC), the like, or a combination or sub-combination thereof. The base 102 may include a heel 106. The heel 106 may be the bottom, rear part of the shoe 100 and may support the heel of the foot of the user. The heel 106 may have any suitable height. For example, the heel 106 may be relatively tall (e.g., high) for fashion purposes, to make the user appear taller, to adjust the posture of the user, or for any other purpose. As another example, the heel 106 may be short (e.g., low) or omitted to provide a flat suitable for more practical and/or comfortable use of the shoe 100. Thus, although the base 102 is shown in FIG. 1 having a higher heel, the base 102 may have any suitable configuration (e.g., may be configured as a flat or the like).

The upper 104 may be configured to assist in holding the shoe 100 onto the foot of the user. In the simplest cases, such as where the shoe 100 is a sandal or a flip-flop, the upper 104 may be or comprise one or more straps for supporting the base 102 on the foot (e.g., to hold the base 102 against a bottom of the foot). Alternatively, the upper 104 may be more complex and/or robust to better support the base 102 on the foot (as compared to the upper 104 of a sandal or a flip-flop), to protect the foot, or for some other purpose.

The upper 104 may be placed or extend over the foot of the user. That is, the upper 104 may support the foot (e.g., sides of the foot) and/or the ankle. The upper 104 may completely or nearly completely cover all or portions (e.g., large portions) of the foot of the user, the ankle, and/or the leg of the user such that the foot, the ankle, and/or the leg are hidden by the upper 104. Alternatively, the upper 104 may include straps that cover a relatively small portion of the foot. The upper 104 may be releasable relative to the base 102 (e.g., may be releasably couplable to the base 102). In other words, the upper 104 may be releasably attached to the base 102 so that at different times or occasions, different instances of the uppers 104 may be applied or worn on the base 102.

Figure 2:
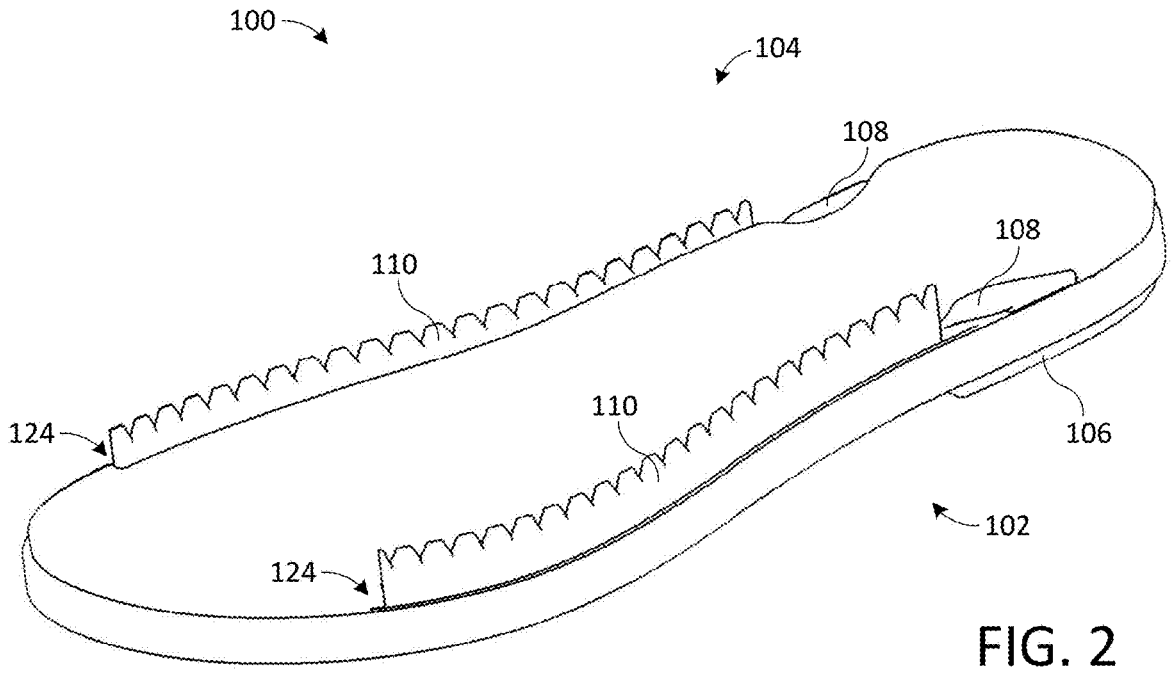
FIG. 2 is an upper perspective view of a shoe according to an example.
Figure 3:
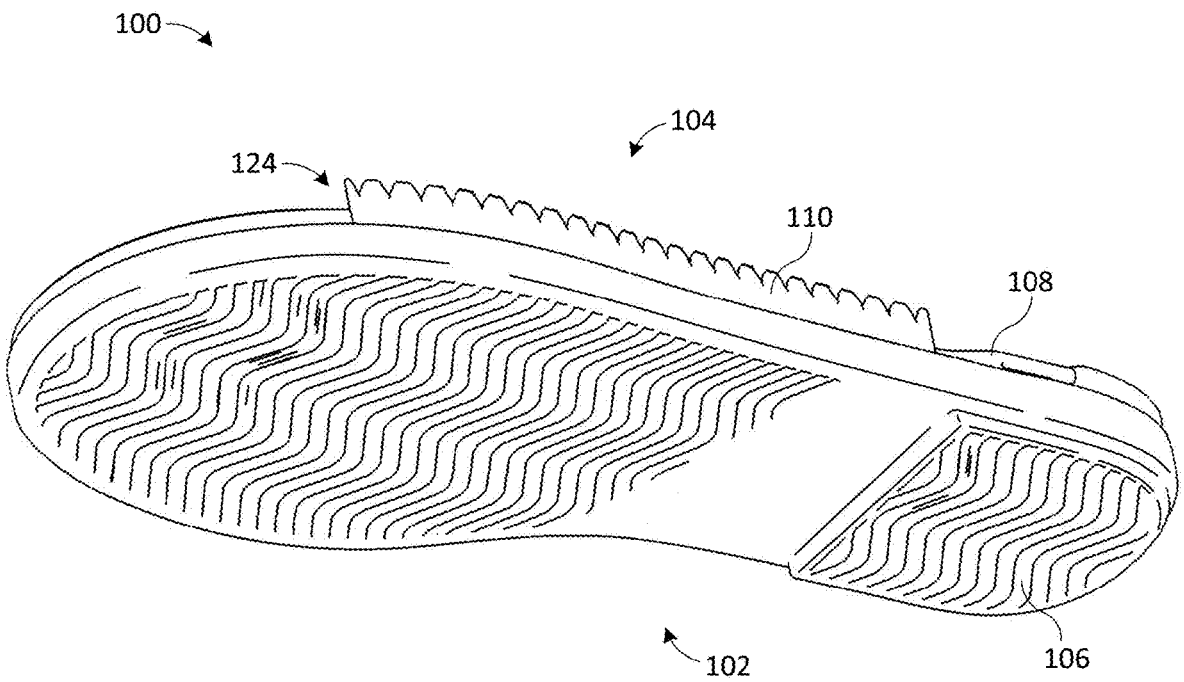
FIG. 3 is a lower perspective view of the shoe of FIG. 2.
Figure 4:
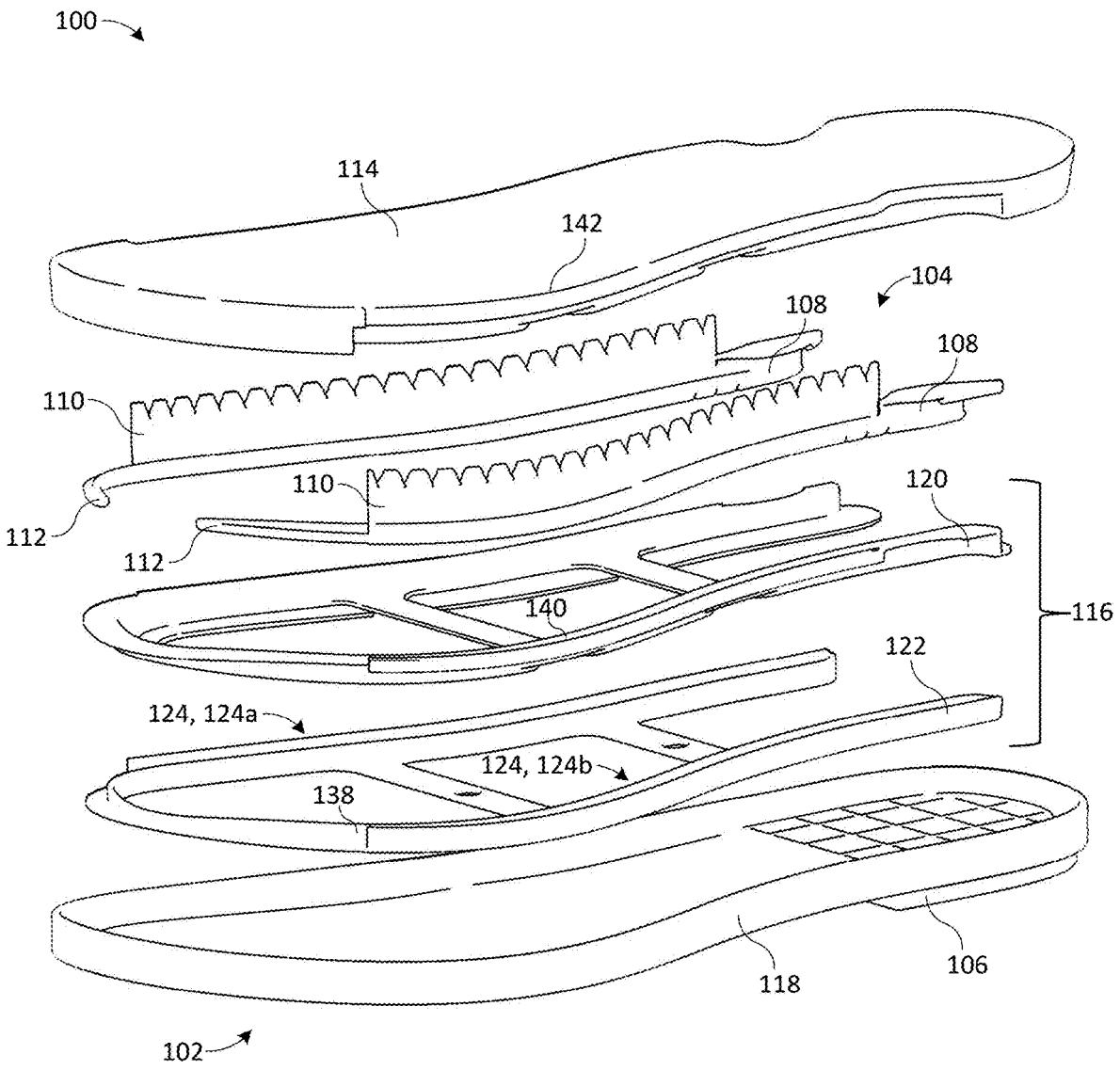
FIG. 4 is an exploded view of the shoe of FIG. 2.

Referring to FIGS. 2-4, an example of the shoe 100 is illustrated that includes the base 102 and only a portion of the upper 104. The remainder of the upper 104 (e.g., the portion of the upper 104 that extends over a top portion of the foot) is omitted; however, this is only for simplicity of the illustration and the upper 104 of the shoe 100 may include the omitted remainder. The portion of the upper 104 that is shown includes two rails 108 and an interface 110 that extends upward from each of the rails 108. The rails 108 may be located on each of a lateral side and a medial side of the upper 104 and may be configured to connect the upper 104 to the base 102 (as explained in further detail below). The interface 110 may be configured to connect the rails 108 to the remainder of the upper 104 (e.g., by stitching the interface 110 to the remainder of the upper 104). As shown, in some implementations, the interface 110 may extend along only a portion of the length of the rails 108 such that a toe portion 112 of the rails 108 extends beyond the interface 110.

As best shown in FIG. 4, the base 102 may comprise multiple layers, including a topsole 114 (which may be referred to as a footbed or, in certain situations, an insole), a midsole 116, and an outsole 118. In some implementations, one or more of the topsole 114, the midsole 116, and the outsole 118 may be formed from multiple layers. For example, as shown, the midsole 116 may comprise an upper midsole 120 and a lower midsole 122. One or more of the topsole 114, the midsole 116, and the outsole 118 may be formed from different materials or different combinations of materials, or may be formed from the same materials or combination of materials. In some implementations one or more of the topsole 114, the midsole 116, and the outsole 118 may be omitted, and in some implementations the base 102 may comprise only a single layer (e.g., may comprise only one of the topsole 114, the midsole 116, or the outsole 118 or may comprise two of the topsole 114, the midsole 116, and/or the outsole 118). For example, in certain implementations, the midsole 116 may form the footbed and a topsole 114 may be omitted.

The topsole 114 may form a top portion of the base 102 such that the topsole 114 sits directly beneath the user's foot during use and may include a cushioning material to increase user comfort. In some implementations, the topsole 114 may have a topography that is configured to conform to the average anatomy of the bottom of a human foot. Alternatively, the topsole 114 may have a custom topography that is configured to conform to the anatomy of an individual user. The outsole 118 may be the portion of the base 102 that is in direct contact with the ground during use. The outsole 118 may be made of leather, natural rubber, synthetic material (e.g., polyurethane), or some other suitable material. The outsole 118 may comprise a single piece or may be an assembly of separate pieces (e.g., separate pieces formed of the same or different materials). For example, the outsole 118 may include or define the heel 106 that is the same material or a different material as the remainder of the outsole 118. The outsole 118 or a lower (e.g., bottom) portion of the outsole 118 may be configured to resist wear, grip a ground surface (e.g., to reduce slipping of the user as they walk or otherwise move across the ground surface), the like, or a combination thereof. For example, as best shown in FIG. 3, the bottom portion of the outsole 118 may include treads (e.g., ribs) or some other feature or texture that is configured to grip the ground surface.

The midsole 116 may be disposed between the outsole 118 and the topsole 114. In some implementations, the midsole 116 may provide shock absorption for the user during use. Additionally or alternatively, the midsole 116 may provide structural support to the base 102 and/or facilitate a connection between the topsole 114 and the outsole 118. As described previously, the midsole 116 may comprise multiple layers such as the upper midsole 120 and the lower midsole 122. In some implementations, the base 102 may not include the midsole 116.

One or more of the topsole 114, the midsole 116, and the outsole 118 may form a feature that is configured to interface with the upper 104 (or a portion thereof) for removably coupling the upper 104 to the base 102. For example, as shown, the midsole 116 and the topsole 114 may cooperatively form the grooves 124 (which may be referred to as tracks) that are configured to receive the rails 108 of the upper 104. The rails 108 of the upper 104 are configured to be inserted into the grooves 124 of the base 102 to releasably couple (e.g., attach) the upper 104 to the base 102. For example, the rails 108 may be configured to slide into the grooves 124 from a rear of the base 102 toward a front of the base 102 to couple the upper 104 to the base 102. The rails 108 and the grooves 124 may be referred to collectively as an attachment.

In certain implementations, in a particular instance of a shoe 100, one instance of a groove 124 may extend to engage or connect with another instance of a groove 124. For example, in the toe area of a shoe 100, the upper midsole 120 and the lower midsole 122 may collectively define a groove 124 that includes or connects a medial groove 124*a* (e.g., a groove 124 that is located on a medial side of the base 102 and is configured to extend along or proximate a medial side of the foot of a user) to a lateral groove 124*b* (e.g., a groove 124 that is located on a lateral side of the base 102 and is configured to extend along or proximate a lateral or outer side of the foot of the user). In selected implementations, this continuous instance of a groove 124 in the toe area of a shoe 100 may provide a space for receiving a toe portion 112 of each of the rails 108.

Figure 5:
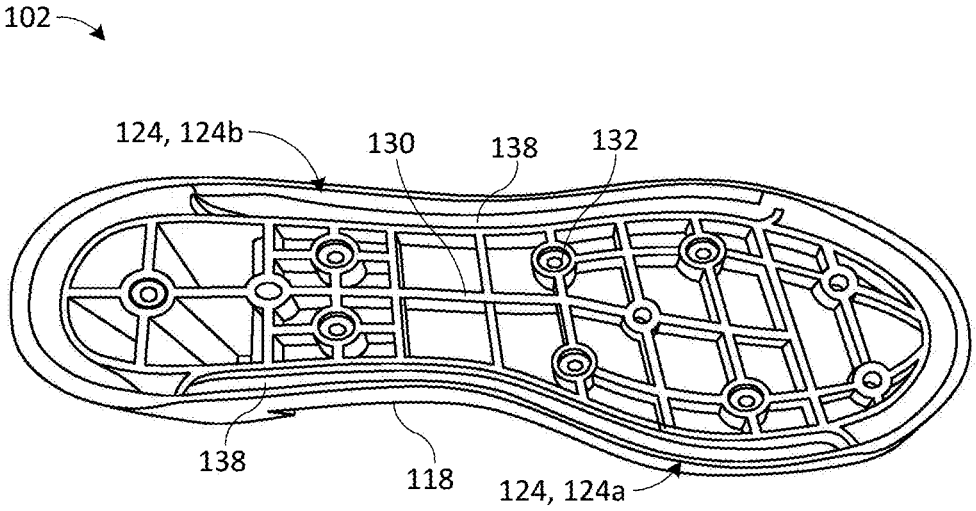
FIG. 5 is an upper perspective view of an outsole of the shoe of FIG. 1.

Referring to FIG. 5, an example of the outsole 118 of the base 102 is illustrated. As shown, the outsole 118 may include ribs 130 that are configured to provide structural support to the base 102. For example, the ribs 130 may stiffen the outsole 118 and thereby resist bending which may otherwise cause the upper 104 to become disconnected from the base 102 (e.g., by causing deformation of the grooves 124). Furthermore, the outsole 118 may include attachment features 132 that are configured to interface with corresponding features of the midsole 116 to form a connection therebetween. For example, as shown, the attachment features 132 may be or comprise apertures that extend partially through a thickness of the outsole 118. Where the attachment features are or comprise such apertures, the attachment features 132 may be configured to receive corresponding features (e.g., corresponding protrusions) of the midsole 116 or may be configured to receive fasteners that extend through the midsole 116. In some implementations, the attachment features 132 may be supported by the ribs 130. Furthermore, in some implementations, spaces between the ribs 130 may be filled with a material (e.g., foam or polyester) to reduce walking-induced noise, to provide additional support to the base 102, and/or for shock absorption.

Figure 6:
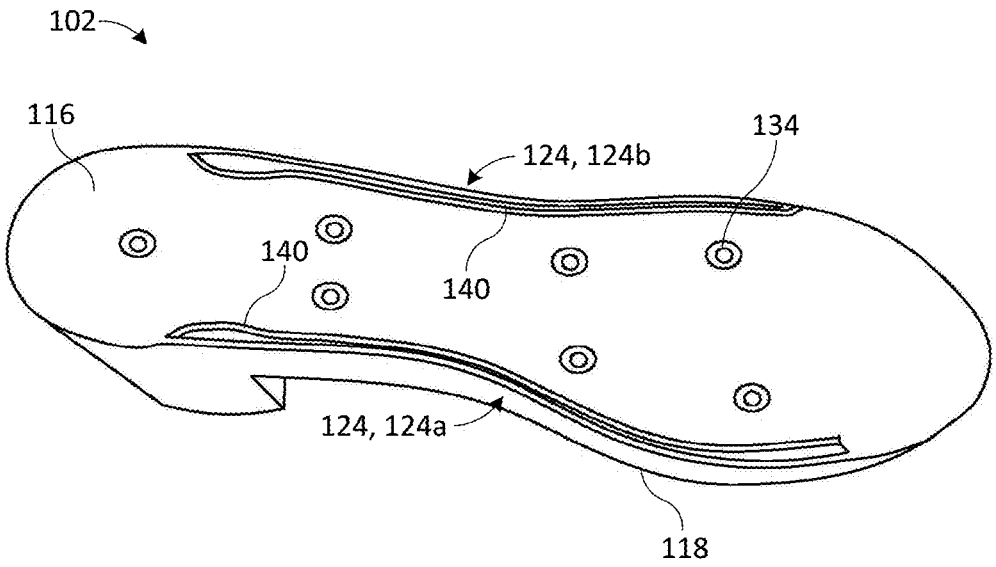
FIG. 6 is an upper perspective view of a midsole and the outsole of the shoe of FIG. 1.

Referring to FIG. 6, an example of the midsole 116 of the base 102 is shown connected to the outsole 118. As described above, the midsole 116 may include corresponding attachment features 134 that are configured to interface with the attachment features 132 of the outsole 118 to connect the midsole 116 to the outsole 118. For example, as shown, the corresponding attachment features 134 of the midsole 116 may be or comprise apertures through which respective fasteners may extend to access or engage attachment features 132 (see FIG. 5) of the outsole 118.

Figure 7:
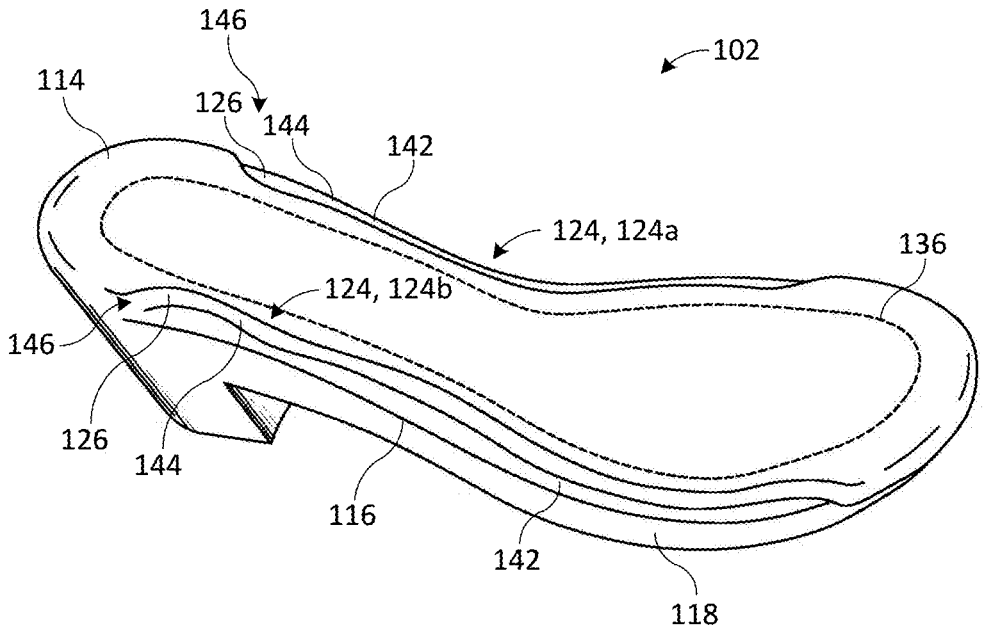
FIG. 7 is an upper perspective view of a topsole, the midsole, and the outsole of the shoe of FIG. 1.

Referring to FIG. 7, an example of the topsole 114 of the base 102 is illustrated connected to the midsole 116 and the outsole 118 to form the base 102. The topsole 114 may be connected to the midsole 116 by any suitable means. For example, the topsole 114 may be connected to the midsole 116 via an adhesive or the like. As described previously, in some implementations the midsole 116 may be omitted. Accordingly, in such implementations, the topsole 114 may be connected directly to the outsole 118 (e.g., via an adhesive, fasteners, or the like). The topsole 114 may be formed from or comprise a soft material such as leather, foam, rubber, or the like to provide cushioning to the foot of the user. In some implementations, the topsole 114 may be comprised of multiple layers that are held together by first stitching 136.

Referring now to FIGS. 5-7, as described above with respect to FIGS. 2-4, one or more of the topsole 114, the midsole 116, and the outsole 118 may form the grooves 124 that are configured to receive the rails 108 of the upper 104 to releasably couple the upper 104 to the base 102. For example, as shown in FIGS. 5-7, the topsole 114, the midsole 116, and the outsole 118 may cooperatively form a medial groove 124*a* (e.g., one of the grooves 124 that is located on a medial side of the base 102 and is configured to extend along or proximate a medial side of the foot of a user) and a lateral groove 124*b* (e.g., one of the grooves 124 that is located on a lateral side of the base 102 and is configured to extend along or proximate a lateral or outer side of the foot of the user). As best shown in FIG. 5, the outsole 118 may form a bottom portion of the grooves 124, which may include a bottom surface 138 of the grooves 124. As best shown in FIG. 6, the midsole 116 may form an intermediate portion of the grooves 124, which may include a geometric feature 140, top, or cap that is configured to retain the rails 108 of the upper 104 within the grooves 124 in a vertical direction (e.g., to prevent the upper 104 from being lifted upward out of the grooves 124). As best shown in FIG. 7, the topsole 114 may form a top portion of the grooves 124, which may cover the intermediate portion of the grooves 124 (e.g., may cover the geometric feature 140) while providing a slot 142 through which the rails 108 (e.g., the interface 110) may extend.

In some implementations, such as the implementation shown in FIG. 4, only the topsole 114 and the midsole 116 may cooperatively form the medial groove 124*a* and the lateral groove 124*b*. In such an implementation, the lower midsole 122 may form the bottom portion of the grooves 124, and thus may include the bottom surface 138 of the grooves 124. The upper midsole 120 may form the intermediate portion of the grooves 124, and thus may include the geometric feature 140, top, or cap that is configured to retain the rails 108 of the upper 104 within the grooves 124 in a vertical direction. The topsole 114 may still form the top portion of the grooves 124, and thus may cover the intermediate portion of the grooves 124 while providing the slot 142.

Still referring to FIGS. 5-7, the grooves 124 may not extend linearly along the base 102 and may instead include curved and/or arcuate regions. For example, as best shown in FIG. 7, the grooves 124 may each include a sloped area 144 at a rear portion thereof that is configured for receiving respective instances of the rails 108. Other portions of the grooves 124 along the length of the shoe 100 (e.g., along the length of the base 102) may also be curved or sloped such as to follow the contour of the periphery of the base 102.

In some implementations, the grooves 124 and the rails 108 may include features that cooperatively form a detent 146. The detent 146 may be or comprise a device (e.g., a catch, snap, or the like) that is configured for positioning and holding the rails 108 of the upper 104 in relation to the grooves 124 of the base 102. In other words, the detent 146 may allow a user to selectively release the rails 108 from the grooves 124. For example, each of the grooves 124 may include a first portion 126 of the detent 146 that includes a recess in the bottom surface 138 of the grooves 124 and located at a rear of the grooves 124. As explained in further detail below, each of the rails 108 may include a second portion 128 of the detent 146 that is configured to interface (e.g., mate, engage, etc.) with the first portion 126 of the detent 146. For example, where the first portion 126 of the detent 146 is a recess, the second portion 128 of each of the rails 108 may include an elastic member or protrusion that is biased into the recess when the rails 108 are fully inserted into the grooves 124. Through the interface between the first portion 126 of the detent 146 (e.g., the recessed portion of the grooves 124) and the second portion 128 of the detent 146 (e.g., the elastic member or protrusion of the rails 108), relative movement (e.g., inadvertent movement) between the rails 108 and the grooves 124 may be inhibited. According to the above example, when the user wishes to detach the upper 104 from the base 102, the user may lift the elastic member to remove the elastic member from the recess, thereby enabling the rails 108 to slide out of the grooves 124. As another example, the detent 146 may be or include corresponding magnetic features of the grooves 124 and the rails 108. As yet another example, the detent 146 may be or include other mechanisms such as clips or the like.

Figure 8:
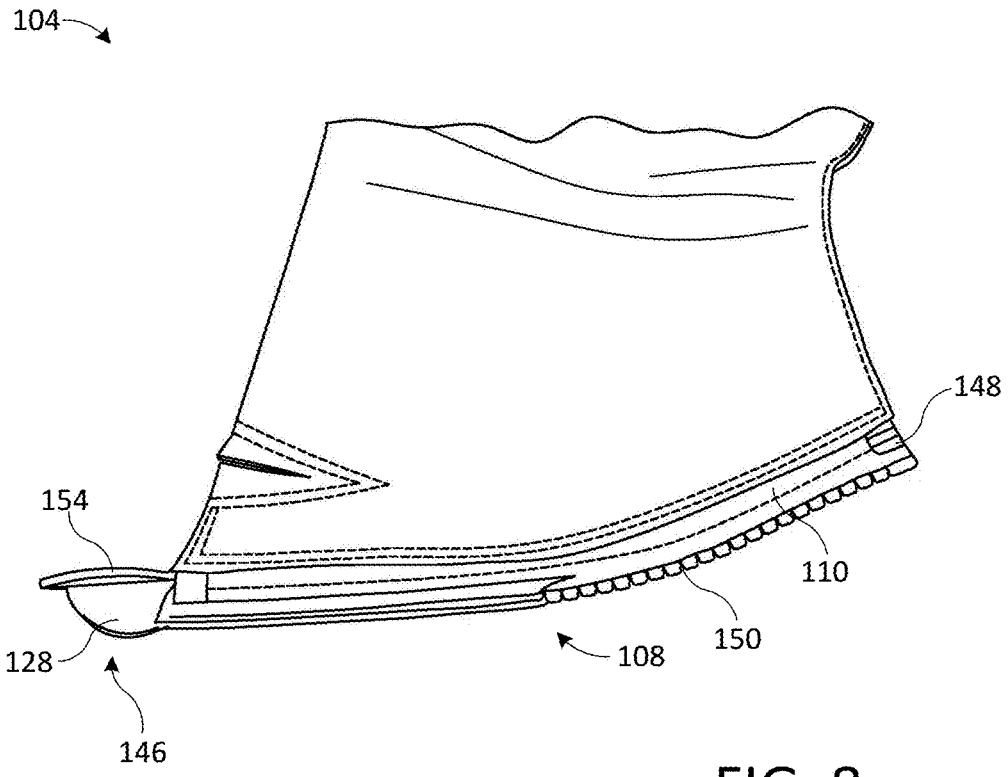
FIG. 8 is a side view of an upper of a shoe according to an example.

Referring to FIG. 8, an example of the upper 104 is illustrated that includes one of the rails 108 (e.g., one of the rails 108 located on the lateral side of the upper 104). However, it will be understood that the upper 104 may include another instance of the rails 108 (e.g., another instance of the rails 108 located on a medial side of the upper 104). The rails 108 may be formed from or comprise any suitable material including, without limitation, thermoplastic polyurethane ("TPU"), polypropylene ("PP") plastic, or any other suitable material. In some implementations, the material of the rails 108 may be selected to reduce a coefficient of friction such that the rails 108 may be easily inserted into the grooves 124.

As shown, the rails 108 may be secured to the remainder of the upper 104 along edges thereof (e.g., along a medial edge and a lateral edge of the upper 104) by the interface 110. As described above with reference to FIGS. 2-4, the interface 110 may be connected to both the rails 108 and the remainder of the upper 104 to form a connection therebetween. In some implementations, the interface 110 may be flexible. For example, the interface 110 may be formed from a cloth material (e.g., nylon or polyester) and bonded (e.g., glued) to the rails 108 and stitched to the remainder of the upper 104 to form a connection therebetween. Where the interface 110 is formed from a cloth material, the interface 110 may be referred to as a webbing. As another example, the interface 110 may be bonded (e.g., glued) to both the rails 108 and the remainder of the upper 104 to form a connection therebetween. As yet another example, the interface 110 may be formed integrally with the rails 108 (e.g., be a monolithic extension of the rest of the rails 108) and may be bonded (e.g., glued) and/or stitched to the remainder of the upper 104 to form a connection therebetween. Where the interface 110 is formed integrally with the rails 108, the interface 110 may be formed from the same material as the rails 108. In some implementations, the interface 110 may be thinner than the rails 108 such as to fit within the slot 142 of the grooves 124.

The interface 110 may include anti-tear features 148 located at one or more ends thereof that are configured to enable the rails 108 and the interface 110 thereof to be trimmed without the interface 110 becoming damaged (e.g., frayed). For example, the anti-tear features 148 may be or comprise perforations, hard plastic, or the like, or some combination thereof that may allow the rails 108 and the interface 110 to be trimmed without the interface 110 becoming damaged. The anti-tear features 148 may also strengthen the interface 110 such as to inhibit damage to the interface 110 upon repeated use of the shoe 100 (e.g., upon repeated insertion and removal of the rails 108 within the grooves 124). The anti-tear features 148 may be located at a front end of the interface 110 (as shown in FIG. 5), at a rear end of the interface 110, or at both the front end and the rear end of the interface 110.

The rails 108 may include one or more flex cuts 150 or notches that allow the rails 108 to flex while being inserted into the grooves 124. As explained previously, the grooves 124 may not extend linearly along the base 102 and may instead include curved and/or arcuate regions. Accordingly, to prevent the rails 108 from binding as the rails 108 travel through the grooves 124, the flex cuts 150 may enable the rails 108 to flex to conform to the curved and/or arcuate regions of the grooves 124. The flex cuts 150 may be positioned longitudinally along the rails 108 and may enable flexion of the rails 108 in an up and down direction, a medial and lateral direction, and/or some other direction or combination thereof.

As explained above, each of the grooves 124 and the rails 108 may include portions of the detent 146 configured to secure the rails 108 within the grooves 124. The first portion 126 of the detent 146 may be in the form of a recess in the bottom surface 138 of each of the grooves 124. Accordingly, the second portion 128 of the detent 146 may be in the form of an elastic member or protrusion that is configured to interface with the first portion 126 of the detent 146 of a respective one of the grooves 124. The elastic member or protrusion may be located at a rear end of the rails 108 and may be configured to deform elastically such that when the rails 108 are fully inserted into the grooves 124, the elastic member or protrusion is biased into the recess of the grooves 124 to inhibit and/or prevent relative movement (e.g., inadvertent relative movement) between the rails 108 and the grooves 124. In some implementations, the second portion 128 of the detent 146 may be or comprise a snap or other mechanism. By inhibiting movement of the rails 108 relative to the grooves 124, irritation of the user's foot caused by movement of the upper 104 relative to the base 102 may be reduced and/or prevented.

The rails 108 may each also include a cap 154. The cap 154 may be placed over the second portion 128 of the detent 146 and may be configured to prevent dirt and debris from entering the grooves 124 once the rails 108 have been fully inserted therein. The cap 154 may also be configured to assist the user in disengaging the detent 146 by providing a geometric feature for the user (e.g., a finger of the user) to pull against. For example, where the first portion 126 of the detent 146 includes the recess and the second portion 128 of the detent 146 includes the elastic member or protrusion, the cap 154 may be substantially flat and extend rearward beyond the elastic member or protrusion such that the user may place their finger under the cap 154 to release the elastic member or protrusion from the recess.

Figure 9A:
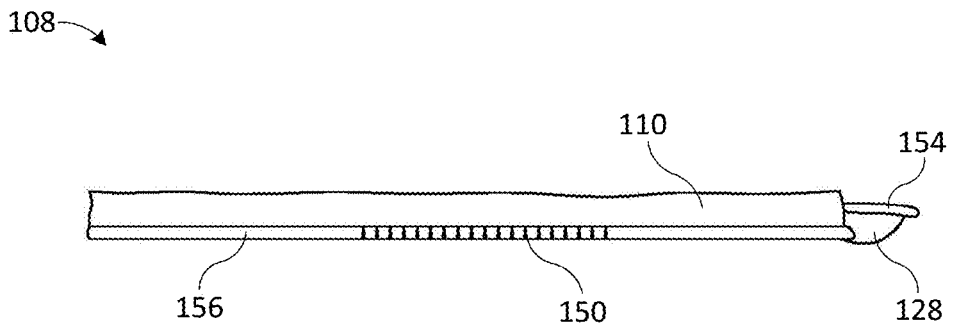
FIGS. 9A-9B are side views of a rail of the upper of FIG. 8.
Figure 9B:
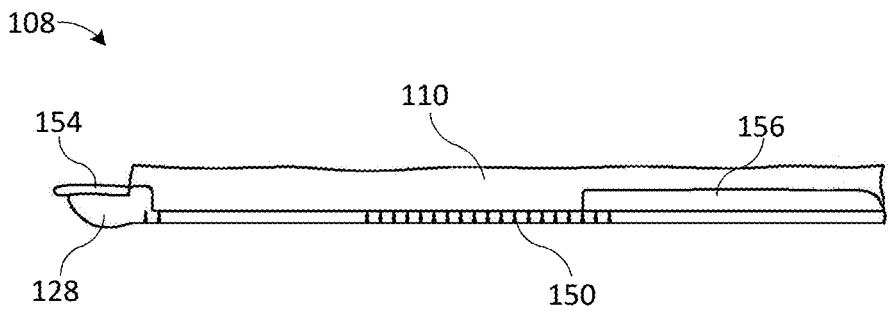

Referring to FIGS. 9A and 9B, an example of one instance of the rails 108 is illustrated. As shown, in some implementations, the interface 110 may terminate at a forward end of the rails 108 such that the rails 108 omit the toe portion 112 (see FIG. 4). Furthermore, in some implementations, the rails 108 may each include a solid section 156 that extends forward beyond the flex cuts 150. The solid section 156 may be configured to allow the rails 108 to be cut after connecting the rails 108 to the remainder of the upper 104 (e.g., by the interface 110). Furthermore, the solid section 156 may enable the manufacture of the rails 108 to be standardized such that the rails 108 may be manufactured independent of the size of the remainder of the upper 104 and later cut to the appropriate size. The solid section 156 may be about 2 cm tall.

Referring to FIGS. 10-13, an example of the shoe 100 is illustrated. The shoe 100 shown in FIG. 10 may be similar to the shoe 100 shown in FIGS. 2-4 such that the lower midsole 122, the upper midsole 120, and the topsole 114 cooperatively form the grooves 124.

Figure 10:
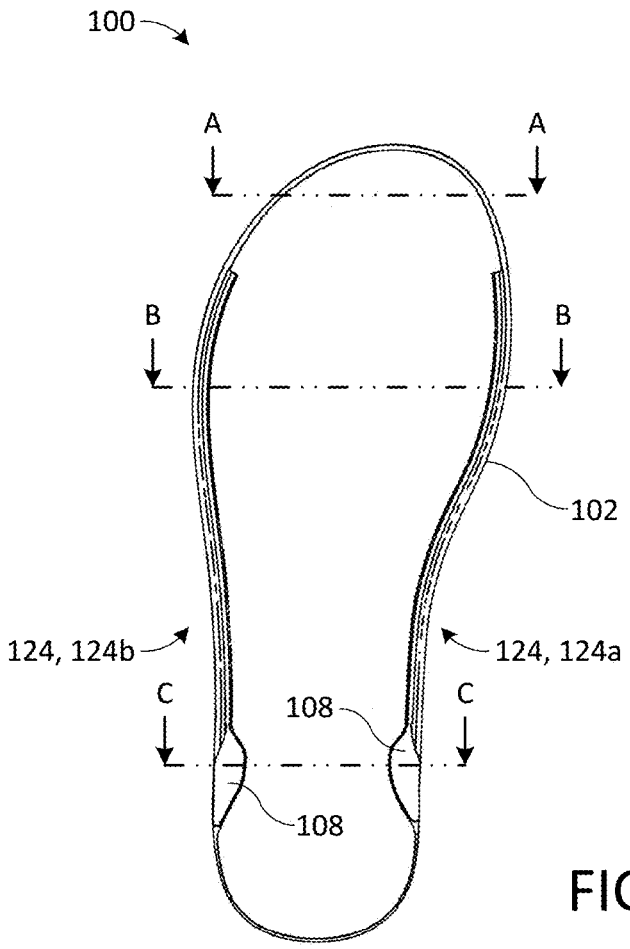
FIG. 10 is a top view of the shoe of FIG. 2.
Figure 11:
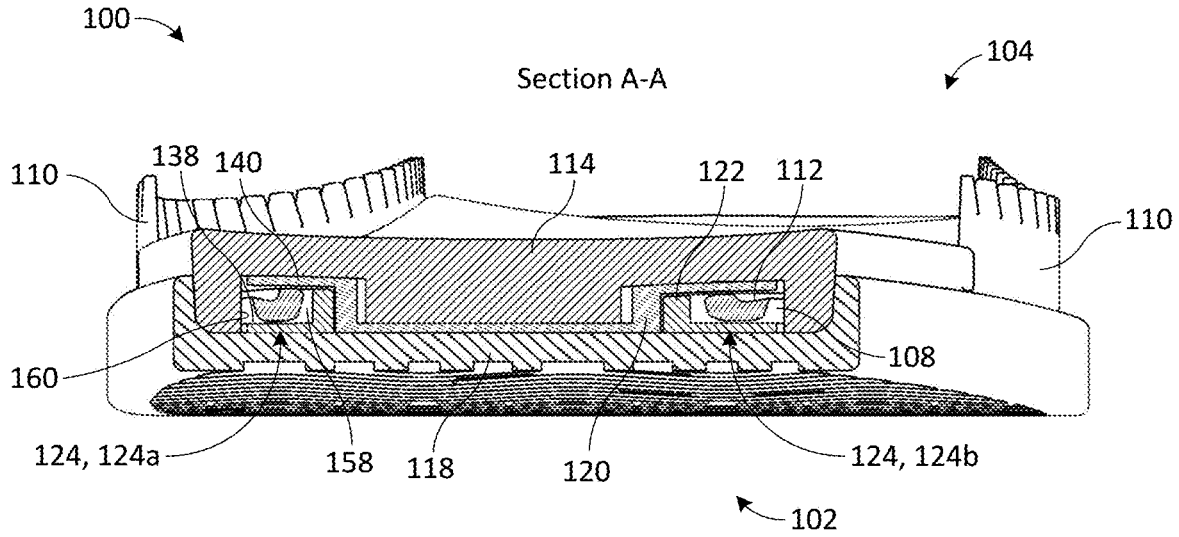
FIG. 11 is a cross-sectional view of the shoe of FIG. 2 taken along line A-A of FIG. 10.

FIG. 11 illustrates a cross-sectional view of the shoe 100 taken along line A-A of FIG. 10. Line A-A extends transversely across a front portion of the shoe 100. As shown, at the front portion of the shoe 100 the outsole 118 may form a U-shape to define a recess for the midsole 116 and the topsole 114 to be disposed to define the grooves 124. The lower midsole 122 may define an L-shaped cross section on each side (e.g., each of a medial side and a lateral side) of the shoe 100 to form the bottom surface 138 and an inner wall 158 of each of the grooves 124. The upper midsole 120 may be partially disposed between the inner wall 158 of each of the grooves 124 and extend outward over each of the grooves 124 to form the geometric feature 140, top, or cap of each of the grooves 124. The topsole 114 may also be partially disposed between the inner wall 158 of each of the grooves 124, may extend outward over the geometric feature 140 of each of the grooves 124, and may extend downward therefrom to form an outer wall 160 of each of the grooves 124.

At the front portion of the shoe 100, the grooves 124 may omit the slot 142, as the interface 110 terminates at a rearward location relative to the front portion. Accordingly, the geometric feature 140, top or cap of the grooves 124 may extend over an entirety of the width of the grooves 124. Accordingly, the toe portion 112 of the rails 108 (e.g., the portion of the rails 108 that extends beyond the interface 110) may be buried within the grooves 124 at the front portion such that the toe portion 112 is covered (e.g., entirely covered) by the geometric feature 140. By burying the toe portion 112 within the grooves 124 at the front portion of the shoe 100, the rails 108 be prevented from disengaging from the grooves 124 during use of the shoe 100 (e.g., as the base 102 flexes during walking). For example, the toe portion 112 being captured inside of the base 102 may form an anchor that resists forces pulling the rail 108 upward out of the groove 124 corresponding thereto. This anchoring may be accomplished even as the base 102 flexes and the grooves 124 flex or change shape during use. As shown, in some implementations, the grooves 124 may define a cross section that is substantially rectangular at the front portion of the shoe 100.

Figure 12:
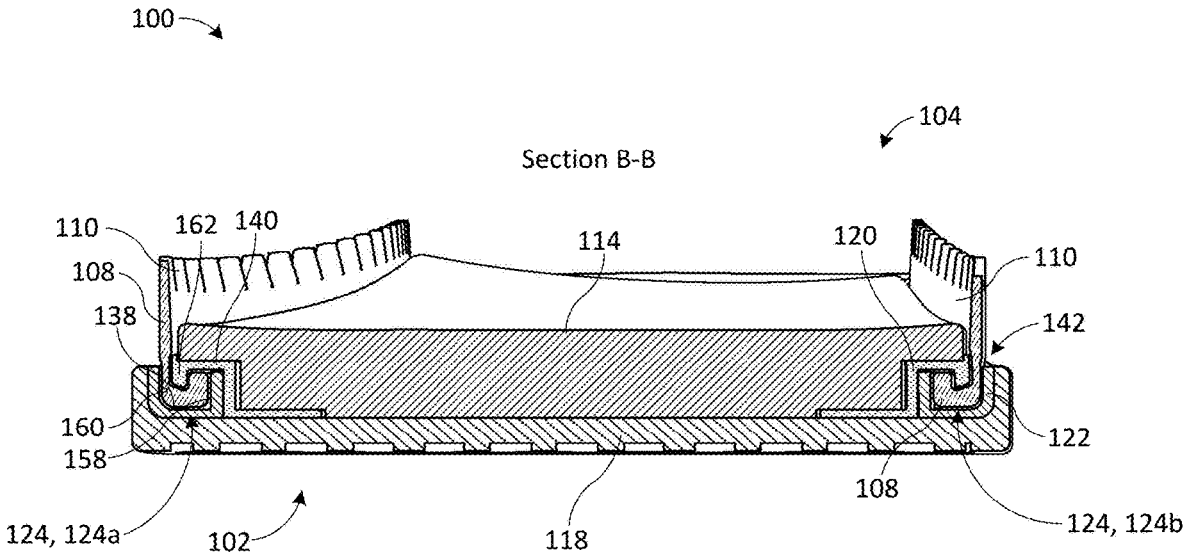
FIG. 12 is a cross-sectional view of the shoe of FIG. 2 taken along line B-B of FIG. 10.

FIG. 12 illustrates a cross-sectional view of the shoe 100 taken along line B-B of FIG. 10. Line B-B extends along a central portion of the shoe 100. As shown, at the central portion of the shoe 100 the outsole 118 may maintain the U-shape as described with respect the front portion of the shoe 100. The lower midsole 122 may define a U-shaped cross section on each side the shoe 100 such as to form the bottom surface 138, the inner wall 158, and the outer wall 160 of each of the grooves 124. The upper midsole 120 may be partially disposed between the inner wall 158 of each of the grooves 124 and extend outward over each of the grooves 124 to form the geometric feature 140, top, or cap of each of the grooves 124. The upper midsole 120 may further extend downward from the geometric feature 140, top, or cap of each of the grooves 124 to form a lip 162. The topsole 114 may also be partially disposed between the inner wall 158 of each of the grooves 124 and may extend outward over the geometric feature 140, top, or cap and the lip 162.

In contrast to the front portion of the shoe 100, at the central portion of the shoe 100 the topsole 114 may terminate at the interface 110. Accordingly, the topsole 114 and the upper midsole 120 (e.g., the lip 162) may cooperatively form the slot 142 through which the interface 110 may extend. As shown, in some implementations, the grooves 124 may define a cross section that resembles an "L" or "J" shaped at the central portion of the shoe 100. In that section, the rails 108 may have a corresponding, complementary, or matching "L" or "J" shape. This may enable each of the rails 108 to mechanically interlock and/or engage a respective instance of the grooves 124 in a manner that resists or resolves loads that would pull the rails 108 upward (i.e., out of the grooves 124). Thus, when an upper 104 is applied to a base 102, the rails 108 may slide longitudinally or lengthwise into the grooves 124 and, when the upper 104 is removed from a base 102, the rails 108 may slide longitudinally or lengthwise out of the grooves 124. However, when the upper 104 is applied to the base 102, the mechanical interlock and/or engagement of the rails 108 and the grooves 124 may be sufficiently strong to withstand loads associated with normal or anticipated use of the shoe 100 that would tend to pull the rails 108 transversely or upwardly out of the corresponding instances of the grooves 124. As noted above, the extending of the toe portions 112 of the rails 108 subsurface within the grooves 124 at the front portion of the shoe 100 may also contribute to resisting or resolving the loads that would tend to pull the rails 108 transversely or upward out of the corresponding instances of the grooves 124.

Figure 13:
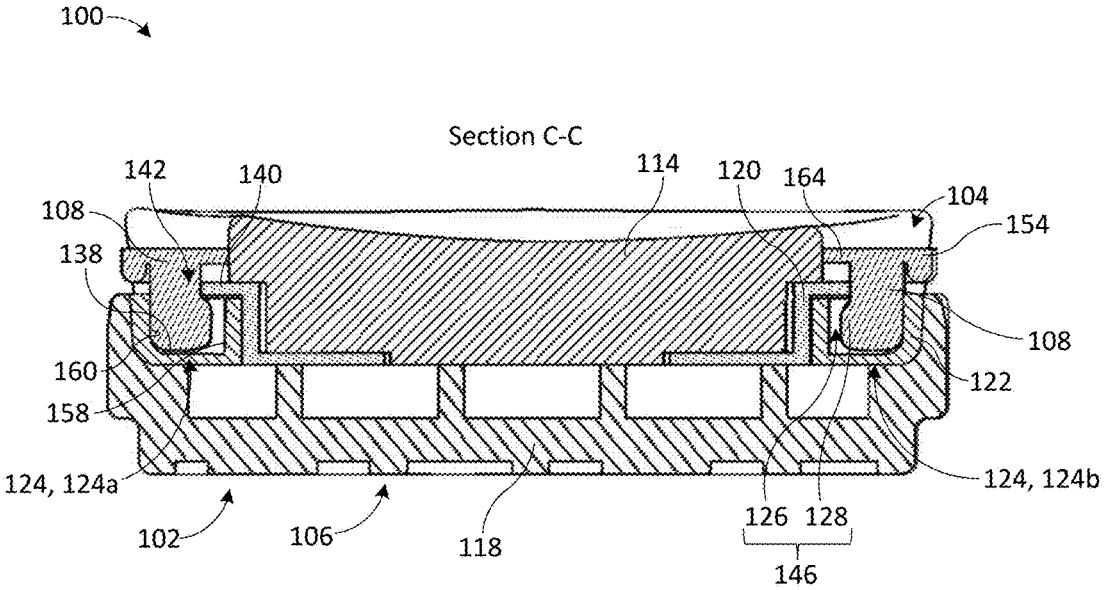
FIG. 13 is a cross-sectional view of the shoe of FIG. 7 taken along line C-C of FIG. 10.

FIG. 13 illustrates a cross-sectional view of the shoe 100 taken along line C-C of FIG. 10. Line C-C extends along a rear portion of the shoe 100. As shown, at the rear portion of the shoe 100 the outsole 118 may maintain the U-shape as described with respect to the rear and central portions of the shoe 100 and may include the heel 106. The lower midsole 122 may maintain the U-shaped cross section as described with respect to the central portion of the shoe 100 such as to form the bottom surface 138, the inner wall 158, and the outer wall 160 of each of the grooves 124. The upper midsole 120 may be partially disposed between the inner wall 158 of each of the grooves 124 and extend outward over each of the grooves 124 to form the geometric feature 140, top, or cap of each of the grooves 124. At the rear portion, however, the upper midsole 120 may omit the lip 162. The topsole 114 may also be partially disposed between the inner wall 158 of each of the grooves 124 and may extend outward over a portion of the geometric feature 140, top, or cap. In contrast to the central portion of the shoe 100, at the rear portion of the shoe 100 the topsole 114 may terminate at a stanchion 164 or lateral boundary or edge of each of the rails 108.

As previously described, the rails 108 may each include the second portion 128 of the detent 146 in the form of an elastic member or protrusion that is configured to interface with the first portion 126 of the detent 146 in the form of a recess in the grooves 124. Accordingly, because the elastic member or protrusion may be lifted upward and out of the recess, the slot 142 may be wider at the rear portion of the shoe 100 relative to other locations of the shoe 100 to enable the rails 108 to be lifted upward without substantial interference with the geometric feature 140, top, or cap of each of the grooves 124 as the upper 104 is removed from the base 102. Conversely, the slot 142 may be wider at the rear portion of the shoe 100 relative to other locations of the shoe 100 to enable the rails 108 to be inserted into the grooves 124 without substantial interference with the geometric feature 140, top, or cap of each of the grooves 124 as the upper 104 is applied to the base 102 (e.g., as the rails 108 are inserted into the grooves 124 at the rear portion of the base 102). As shown, in some implementations, the grooves 124 may define a cross section that resembles an inverted "P" shape at the rear portion of the shoe 100. In that section, the rails 108 may have a corresponding, complementary, or matching inverted "P" shape. This may enable each of the rails 108 to mechanically interlock and/or engage a respective instance of the grooves 124 to form a detent 146 as described above.

Although examples of the grooves 124 are shown in FIGS. 11-13, the grooves 124 may include any suitable cross-sectional shape. For example, the cross-sectional shape of the medial grooves 124*a* may be different than the cross-sectional shape of the lateral grooves 124*b*. Furthermore, the cross-sectional shape of the grooves 124 may vary along the length of the shoe 100 (e.g., may vary along the length of the base 102). The grooves 124 may also include chamfers, bevels, or the like to reduce friction or mitigate binding when inserting/removing the rails 108 into/from the grooves 124. The width of the grooves 124 may also vary along the length of the shoe 100 (e.g., may vary along the length of the base 102), which may further mitigate binding when inserting/removing the rails 108 into/from the grooves 124. In some implementations, the grooves 124 may be wider at the rear portion of the shoe 100 than at the front portion of the shoe 100 (e.g., the width of the grooves 124 may taper down from the rear portion of the shoe 100 to the front portion of the shoe 100.

Figure 14:
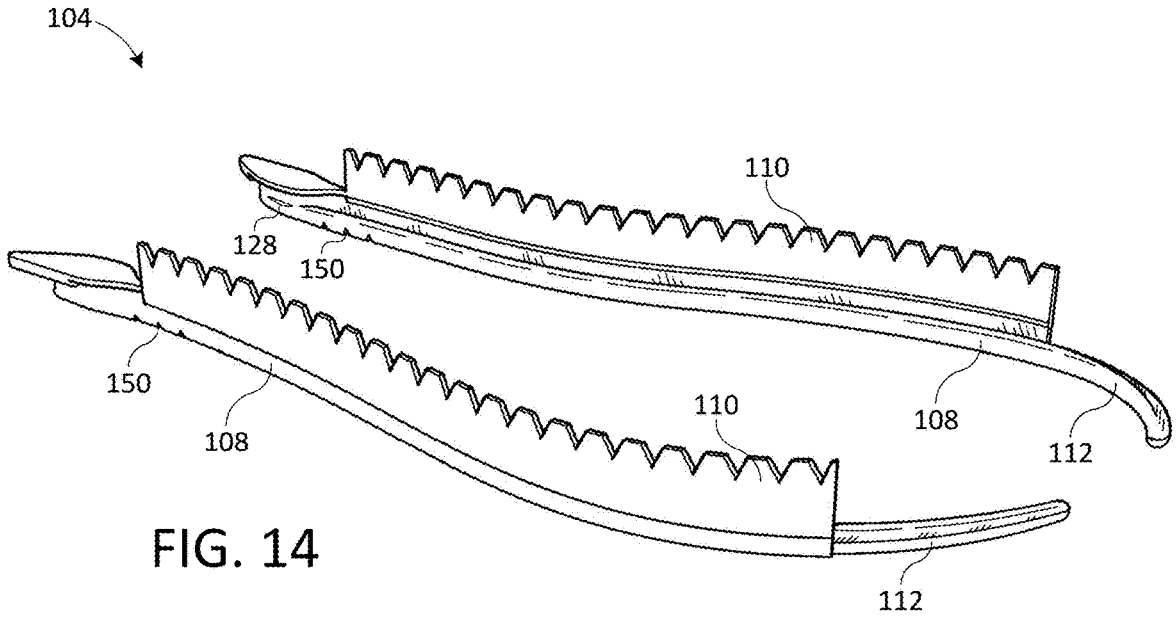
FIG. 14 is a perspective view of a pair of rails of an upper according to an example.
Figure 15A:
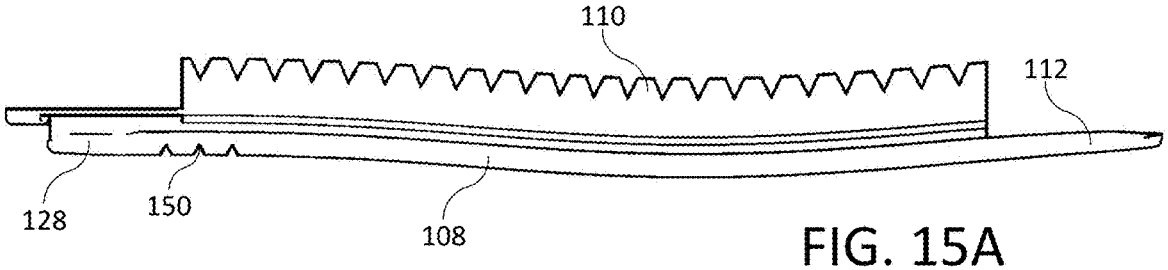
FIG. 15A is an interior side view of one of the rails of FIG. 14.
Figure 15B:
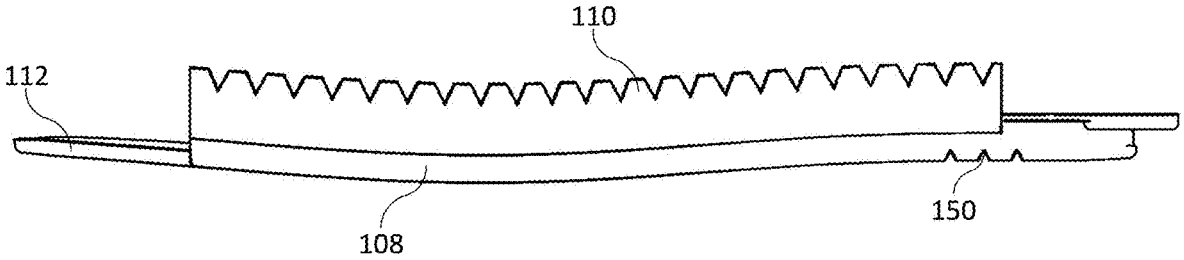
FIG. 15B is an exterior side view of the rail of FIG. 15A.

Referring to FIGS. 14, 15A, and 15B, an example of another instance of the rails 108 is illustrated. FIG. 14 shows a perspective view of two instances of the rails 108 that may correspond to a single instance of an upper 104. FIG. 15A shows an interior side view of one of the rails 108 (e.g., a medial one of the rails 108). FIG. 15B shows an exterior side view of the rails 108 of FIG. 15A. As shown, in some implementations, both of the rails 108 of the upper 104 may be symmetrical (e.g., symmetrically identical to one another). Stated differently, one of the rails 108 (e.g., a medial one of the rails 108) may be mirrored with respect to another of the rails 108 (e.g., a lateral one of the rails 108).

As described previously, the rails 108 may include one or more flex cuts 150 or notches that allow the rails 108 to flex while being inserted into the grooves 124 (e.g., to allow the rails 108 to conform to the curved and/or arcuate regions of the grooves 124. Additionally, or in the alternative, the rails 108 may be formed from or comprise a flexible material (e.g., an elastomer) to enable the rails 108 to flex while being inserted into the grooves 124 and during use of the shoe 100 once assembled. For example, where the grooves 124 include curved and/or arcuate regions (e.g., where the grooves 124 do not extend linearly along the base 102), the flexible material may enable the rails 108 to flex to conform to the curved and/or arcuate regions of the grooves 124 (e.g., may prevent binding of the rails 108 with the grooves 124) while inserting the rails 108 into the grooves 124.

In some implementations, the flex cuts 150 may enable the rails 108 to flex to a greater extent than the flexible material that comprises (e.g., forms) the rails 108 enables. Stated differently, the flex cuts 150 may be configured to enable the rails 108 to flex to a first degree and the material that forms the rails 108 may enable the rails 108 to flex to a second degree that is less than the first degree. In some implementations, the flex cuts 150 may enable the rails 108 to conform to curved and/or arcuate regions of the grooves 124 that have a smaller radius than other curved and/or arcuate regions of the grooves 124, and the material that forms the rails 108 may enable to rails 108 to conform to the other curved and/or arcuate regions of the grooves 124. In some implementations, the flexible material may be or comprise thermoplastic polyurethane (TPU). In other implementations, the flexible material may be some other material that enables elastic deformation (e.g., flexion) of the rails 108 as the rails 108 are inserted into the grooves 124.

Figure 16:
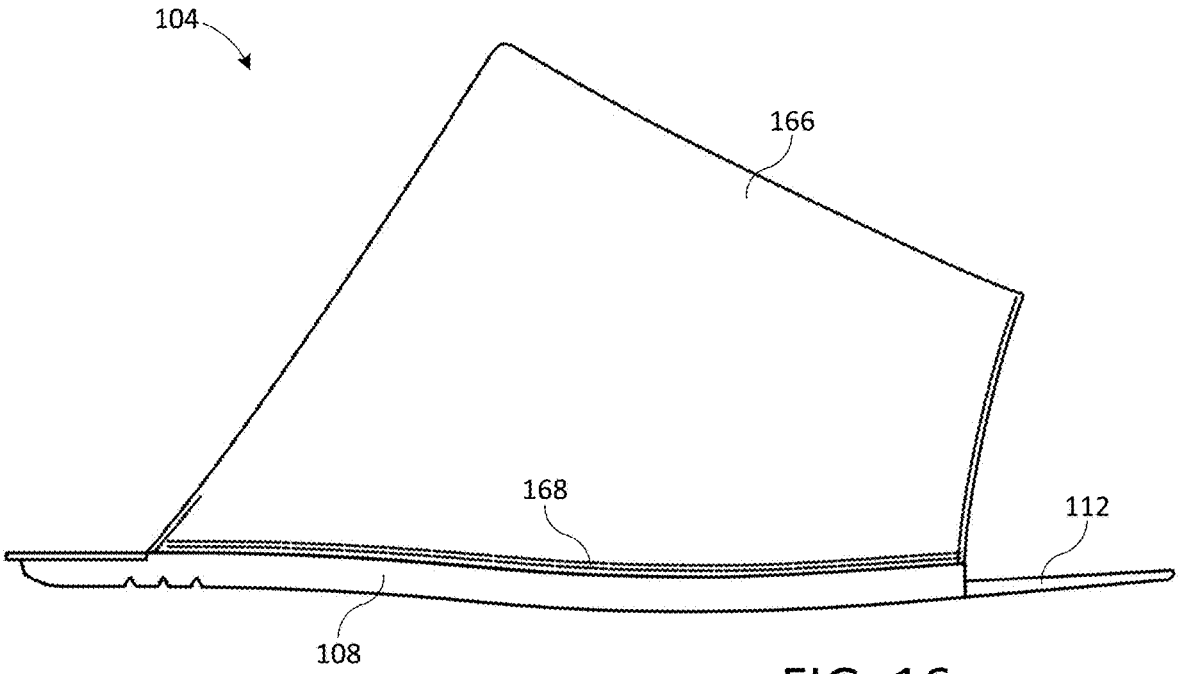
FIG. 16 is a side view of an upper of a shoe according to an example.

Referring to FIG. 16, an example of an upper 104 is shown that that includes a strap portion 166 formed from a single length of material that extends from a medial side of the upper 104 to a lateral side of the upper 104. As shown, the strap portion 166 of the upper 104 is connected to the rails 108 via the interface 110 (e.g., second stitching 168 secures the strap portion 166 to the interface 110 of each instance of the rails 108). Accordingly, because the strap portion 166 of the upper 104 is formed from a single length of material, the interface 110 may extend continuously along a portion of the length of the upper 104 to connect the strap portion 166 to the rails 108.

Figure 17:
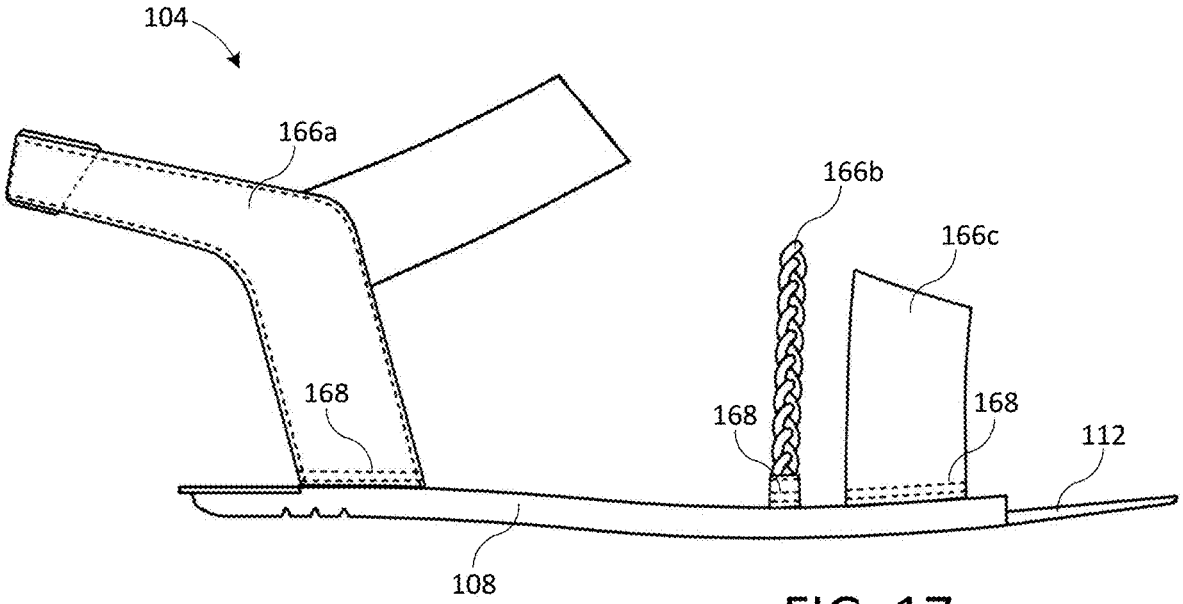
FIG. 17 is a side view of an upper of a shoe according to an example.

Referring to FIG. 17, another example of an upper 104 is shown that includes a first strap portion 166*a*, a second strap portion 166*b*, and a third strap portion 166*c* with each such portion being formed of a different length of material that extends from a medial side of the upper 104 to a lateral side of the upper 104. As shown, each length of the first strap portion 166*a*, second strap portion 166*b*, and third strap portion 166*c* of the upper 104 is connected to the rails 108 via a separate (e.g., discrete) portion of the interface 110. For example, the first strap portion 166*a* of the upper 104 includes material configured to extend around an ankle and/or a heel region of a user. The second strap portion 166*b* of the upper 104 includes a thin decorative roping material that is configured to extend over the foot of the user. The third strap portion 166*c* of the upper 104 includes a length of material that is also configured to extend over the foot of the user. Accordingly, the first strap portion 166*a* may be connected to the rails 108 via a first length of the interface 110, the second strap portion 166*b* may be connected to the rails 108 via a second length of the interface 110, and the third strap portion 166*c* may be connected to the rails 108 via a third length of the interface 110. In some implementations, the first length of the interface 110, the second length of the interface 110, and the third length of the interface 110 may be separate. In some implementations, the interface 110 may extend only along portions of the rails 108 that correspond to the first strap portion 166*a*, second strap portion 166*b*, and third strap portion 166*c*. Stated differently, where the first strap portion 166*a*, second strap portion 166*b*, and third strap portion 166*c* do not connect to the rails 108, the interface 110 may be omitted (e.g., cut away during a manufacturing process). Thus, a standardized instance of the rail 108 or a standardized combination of two instances of the rails 108 may be adapted for use in uppers 104 of various designs.

Figure 18:
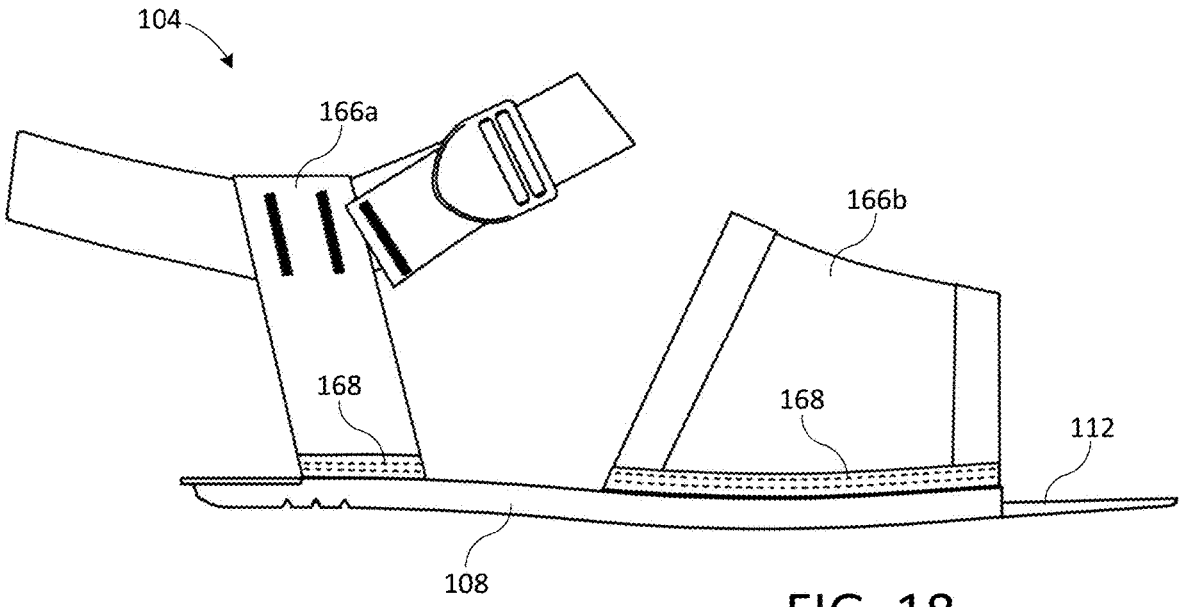
FIG. 18 is a side view of an upper of a shoe according to an example.

Referring to FIG. 18, another example of an upper 104 is shown that includes a first strap portion 166*a* and a second strap portion 166*b* each formed from a length of material that extends from a medial side to a lateral side. As shown, the first strap portion 166*a* and second strap portion 166*b* of the upper 104 are connected to the rails 108 via separate (e.g., discrete) portions of the interface 110. For example, the first strap portion 166*a* of the upper 104 includes material configured to extend around an ankle and/or a heel region of a user and includes a buckle. The second strap portion 166*b* of the upper 104 includes a length of material that is configured to extend over the foot of the user.

Accordingly, the first strap portion 166*a* may be connected to the rails 108 via a first length of the interface 110 and the second strap portion 166*b* may be connected to the rails 108 via a second length of the interface 110. In some implementations, the first length of the interface 110 and the second length of the interface 110 may be separate (e.g., the intermediate portion of the interface 110 located between the first length of the interface 110 and the second length of the interface 110 may be cut away during a manufacturing process).

The rails 108 and/or the interface 110 may be configured to be connected to variations of the base 102 and/or the strap portion 166, first strap portion 166*a*, second strap portion 166*b*, third strap portion 166*c*, etc. For example, the rails 108 may be manufactured according to a standard size (e.g., length) and the interface 110 may be manufactured to extend continuously along a central or main portion of the rails 108. In some implementations, the rails 108 may be subsequently cut to reduce the length thereof to fit a certain size and/or style of the base 102. Similarly, the continuous length of the interface 110 may be subsequently cut to remove sections or portions of the interface 110 that do not have a strap portion 166, first strap portion 166*a*, second strap portion 166*b*, third strap portion 166*c*, etc. corresponding thereto. For example, the continuous length of the interface 110 may be cut to form the first length, the second length, and the third length of the interface 110 as described above with respect to FIG. 17. As another example, the continuous length of the interface 110 may be cut to form the first length and the second length of the interface 110 as described above with respect to FIG. 18.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A shoe comprising:

a base configured to contact a ground, the base including a groove, the groove including a recess; and an upper configured to extend over a foot of a user, the upper including a rail, the rail comprising an elastic member and being configured to be inserted into the groove to connect the upper to the base, wherein the recess and the elastic member cooperatively form a detent that is configured to selectively inhibit relative movement between the rail and the groove when the rail is fully inserted into the groove.

2. The shoe of claim 1, wherein the elastic member is configured to be biased into the recess when the rail is fully inserted into the groove.

3. The shoe of claim 1, wherein the rail is configured to slide into the groove from a rear of the base toward a front of the base.

4. The shoe of claim 3, wherein the groove includes a geometric feature that is configured to retain the rail within the groove in a vertical direction.

5. The shoe of claim 4, wherein the geometric feature extends over an entirety of a width of the groove at a front portion of the shoe.

6. The shoe of claim 5, wherein the geometric feature is configured to entirely cover a toe portion of the rail when the rail is fully inserted into the groove.

7. An interchangeable shoe comprising:

a base;

an upper; and an attachment configured to releasably attach the upper to the base, the attachment including:

a groove in the base, wherein the groove includes a first portion of a detent; and a rail attached to the upper that is configured to be inserted into and removed from the groove, wherein the rail includes a second portion of the detent that is configured to mate with the first portion of the detent.

8. The interchangeable shoe of claim 7, wherein the rail includes one or more flex cuts.

9. The interchangeable shoe of claim 7, wherein the base includes a flat.

10. The interchangeable shoe of claim 7, wherein the base includes a heel.

11. The interchangeable shoe of claim 7, wherein the upper is configured to completely cover a foot of a user.

12. The interchangeable shoe of claim 7, wherein the upper is configured to cover only a portion of a foot of a user.

13. A modular shoe comprising:

a base configured to support a weight of a user, the base including a groove, wherein the groove includes a geometric feature; and an upper configured to extend over a foot of the user, the upper including a rail configured to be inserted into the groove to releasably couple the upper to the base, wherein:

the rail includes a toe portion, and the geometric feature is configured to extend over an entirety of a width of the groove to cover the toe portion of the rail when the rail is fully inserted into the groove.

14. The modular shoe of claim 13, wherein the groove is a first groove located on a lateral side of the base and the rail is a first rail located on a lateral side of the upper, the shoe further comprising:

a second groove located on a medial side of the base; and a second rail located on a medial side of the upper and configured to be inserted into the second groove to releasably couple the upper to the base, wherein a portion of the upper is configured to extend over the foot of the user from first rail to the second rail.

15. The modular shoe of claim 14, wherein:

the toe portion of the first rail is a first toe portion;

the second rail includes a second toe portion; and the first toe portion and the second toe portion extend beyond the portion of the upper that is configured to extend over the foot of the user from the first rail to the second rail.

16. The modular shoe of claim 15, wherein:

the first rail comprises a first interface extending upward out of the first groove; and the second rail comprises a second interface extending upward out of the second groove.

17. The modular shoe of claim 16, wherein the rail is configured to slide into the groove from a rear of the base toward a front of the base to releasably couple the upper to the base.

18. The modular shoe of claim 13, wherein the base comprises:

a topsole configured to sit directly beneath the foot of the user;

an outsole configured to directly contact a ground beneath the foot of the user; and a midsole disposed between the topsole and the outsole, wherein the midsole forms the geometric feature of the groove.

19. The modular shoe of claim 18, wherein the midsole forms a bottom surface of the groove.

* * * * *